US007247065B2

(12) United States Patent
Ito

(10) Patent No.: US 7,247,065 B2
(45) Date of Patent: Jul. 24, 2007

(54) OUTBOARD MOTOR

(75) Inventor: Yu Ito, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/435,108

(22) Filed: May 16, 2006

(65) Prior Publication Data

US 2006/0258234 A1 Nov. 16, 2006

(30) Foreign Application Priority Data

May 16, 2005 (JP) ..... 2005-143174

(51) Int. Cl.
*B63H 20/32* (2006.01)

(52) U.S. Cl. ..... 440/77

(58) Field of Classification Search ..... 440/77, 440/78

See application file for complete search history.

(56) References Cited

U.S. PATENT DOCUMENTS

| | | | | |
|---|---|---|---|---|
| 4,326,600 | A | 4/1982 | Okazaki et al. | |
| 4,379,702 | A | 4/1983 | Takada et al. | |
| 4,403,971 | A | 9/1983 | Kobayashi et al. | |
| 4,461,250 | A * | 7/1984 | Mohr | 123/198 R |
| 4,522,602 | A | 6/1985 | Okazaki | |
| 4,661,076 | A | 4/1987 | Iwai | |
| 4,698,037 | A | 10/1987 | Watanabe et al. | |
| 4,758,190 | A * | 7/1988 | Van Vuren | 440/77 |
| 4,776,820 | A * | 10/1988 | Mapes | 440/77 |
| 4,917,638 | A | 4/1990 | Kojima | |
| 4,952,180 | A | 8/1990 | Watanabe et al. | |
| 4,968,276 | A | 11/1990 | Hashimoto | |
| 4,971,587 | A | 11/1990 | Uchida et al. | |
| 5,018,998 | A | 5/1991 | Kato | |
| 5,046,976 | A | 9/1991 | Kobayashi et al. | |
| 5,052,961 | A | 10/1991 | Uchida et al. | |
| 5,069,644 | A | 12/1991 | Kobayashi et al. | |
| 5,135,239 | A | 8/1992 | Kato et al. | |
| 5,181,870 | A | 1/1993 | Arai et al. | |
| 5,328,395 | A | 7/1994 | Oishi | |
| 5,489,227 | A | 2/1996 | Ishida et al. | |
| 5,713,771 | A | 2/1998 | Takahashi et al. | |
| 5,765,519 | A | 6/1998 | Watanabe | |
| 5,803,777 | A | 9/1998 | Hiraoka | |
| 5,873,755 | A | 2/1999 | Takahashi et al. | |
| 5,899,778 | A | 5/1999 | Hiraoka et al. | |
| 5,937,818 | A | 8/1999 | Kawai et al. | |

(Continued)

FOREIGN PATENT DOCUMENTS

| | | |
|---|---|---|
| JP | 55-083696 | 6/1980 |
| JP | 10-331622 | 12/1998 |
| JP | 10-338196 | 12/1998 |
| JP | 2004-232590 | 8/2004 |
| JP | 2004-232591 | 8/2004 |
| JP | 2005-344525 | 12/2005 |

*Primary Examiner*—Stephen Avila
(74) *Attorney, Agent, or Firm*—Knobbe, Martens, Olson & Bear LLP

(57) ABSTRACT

An outboard motor can includes an engine for driving a propulsion device, a cowling for covering the engine, a fresh air intake opening formed in the cowling for drawing fresh air, and an engine compartment defined in the cowling. The outboard motor can have a bottom part defined below the engine compartment, a water collecting part disposed below the bottom part for receiving water that entered the cowling, a water passage for communicating the bottom part and the water collecting part, and a drain hole formed in a bottom portion of the water collecting part.

16 Claims, 15 Drawing Sheets

U.S. PATENT DOCUMENTS 5,938,491 A 8/1999 Kawai et al.
5,984,742 A 11/1999 Kimura et al.
5,992,368 A 11/1999 Okamoto
6,017,254 A 1/2000 Katayama et al.
6,066,013 A * 5/2000 Kawamura et al. ..... 440/76
6,074,258 A 6/2000 Arai et al.
6,080,025 A 6/2000 Isogawa et al.
6,095,877 A 8/2000 Kawamukai et al.
6,099,371 A 8/2000 Nozawa et al.
6,106,342 A 8/2000 Kameoka
6,126,499 A * 10/2000 Katayama et al. ..... 440/88 R
6,132,273 A 10/2000 Nakayama et al.
6,216,672 B1 4/2001 Mishima et al.
6,287,161 B1 9/2001 Nozawa
6,296,536 B1 10/2001 Katayama et al.
6,309,267 B1 10/2001 Okabe et al.
6,346,018 B1 2/2002 Watanabe
6,358,105 B1 3/2002 Isogawa
6,390,865 B1 5/2002 Kameoka
6,439,938 B1 8/2002 Katayama
6,620,006 B2 9/2003 Siganuma et al.
6,623,319 B2 9/2003 Isogawa

* cited by examiner

OUTBOARD MOTOR

PRIORITY INFORMATION

The present application is based on and claims priority under 35 U.S.C. § 119 to Japanese Patent Application No. 2005-143174, filed on May 16, 2005, the entire contents of which are expressly incorporated by reference herein.

BACKGROUND OF THE INVENTIONS

1. Field of the Inventions

The present inventions relate to an outboard motor mounted to the outside of a hull, and more particularly to an outboard motor designed to reduce the amount of water entering a cowling and becoming trapped in a bottom part of an engine compartment, as well as arrangements for discharging water or seawater that entered the cowling.

2. Description of the Related Art

Conventionally, outboard motors include an engine inside of a cowling. An intake air duct is usually designed to guide air through the cowling and toward the engine, and such ducts often have a water-separating structure for reducing the amount of water entering the cowling. The intake air duct should have a cross sectional area sufficiently large to provide an adequate amount of air for the engine to operate within its design parameters. Thus, it can be difficult to keep all water out of the intake air duct. Such water can run on the top face of a flywheel magneto cover, for instance, and can remain at a bottom part of the engine compartment within the outboard motor.

Further, such water trapped in the bottom portion of the cowling might be splashed onto the engine and accessory equipment due to vibration or change in the attitude of the outboard motor, resulting in corrosion. Also, the water might be sucked into an intake pipe into the engine.

Salt in seawater can stick to various components of the outboard motor, which can damage its outer appearance. In addition, when a seal for sealing the top cowling to the bottom cowling deteriorates, water might enter the cowling enclosure through deteriorated portion and be trapped in the bottom part, resulting in the foregoing problems.

In order to reduce the amount of water entering the cowling enclosure of outboard motors, some outboard motor cowlings include what is referred to as a "duckbill-type" check valve.

For example, FIG. 11 illustrates a known duckbill-type check valve 100 designed to drain water under the weight of the water itself applied to the valve 100. As such, it takes time for water that entered a cowling 101 to be drained through the valve 100. Further, when the engine 110 operates, it draws in intake air 200 from the interior space within the cowling 101. Thus, a negative pressure is produced in the cowling 101 which interferes with the operation of the duckbill-type check valve 100, preventing water from being drained. As a result, it takes more time for the water trapped in a bottom part 102 to be completely drained, raising the likelihood that the water will be splashed in the bottom part 102.

Other outboard motors include, with reference to FIG. 12, an extended duckbill-type check valve 100. This "extended" type of duckbill check valve 100 generates a head difference D1 between a drain hole 100*a* of the duckbill-type check valve 100 and the bottom part 102, where water is trapped. This design reduces the effect of the negative pressure produced by the flow of intake air 200 into the engine 110 so that the water trapped can be drained more quickly. With this design, water can be drained without being affected by a negative pressure produced with the operation of the engine 110 as long as the head difference D1 is a predetermined value or larger when the negative pressure is a predetermined value or smaller.

With reference to FIG. 13, where extended duckbill valves are used, there is a limit to the magnitude of the head difference D1 that can be generated due to the limited space available within the cowling 101. Thus, in the case in which a higher negative pressure is produced by the flow of the intake air 200 with the operation of a larger outboard engine, for example, the head difference D1 required to compensate for the effect of the negative pressure cannot be provided, so that water 120 may not drain sufficiently quickly.

Further, as noted above, the duckbill-type check valve 100 is designed to drain water under the weight of the water itself. Thus, with reference to FIG. 14, when the outboard motor encounters a big wave 201 in rough weather, or during deceleration or reverse operation of the watercraft, for example, and a large volume of water 120 enters the cowling 101 all at once, the water 120 can be trapped in the bottom part 102. Further, as shown in FIG. 15, the conventional duckbill-type check valve 100 cannot function normally when the outboard motor encounters a big wave 201 and is soaked in the wave up to an upper part of the outboard motor, or up to a position above the duckbill-type check valve 100.

SUMMARY OF THE INVENTIONS

An aspect of at least one of the embodiments disclosed herein includes the realization that providing a water collection device within the cowling of an outboard motor can better protect the components within the cowling from water that has not drained therefrom. For example, as noted above, in the prior art duckbill valve type drainage systems for outboard motors, water enters the cowling and can splash within the cowling before it drains out of the cowling. Additionally, the flow of intake air from the interior of the cowling into the engine can slow the drainage of water. However, by including a water collection device that can collect water in the cowling and drain the water to the outside of the cowling, there is less chance for this water to splash onto the engine within the cowling.

Thus, in accordance with an embodiment, an outboard motor can include an engine configured to drive a propulsion device, a cowling covering the engine, and a fresh air intake opening formed in the cowling configured to guide fresh air into an interior of the cowling. An engine compartment can be defined in the cowling. The outboard motor can also comprise a bottom part defined below the engine compartment, a water collecting part disposed below the bottom part and configured to receive water in the cowling, a first water passage connecting the bottom part and the water collecting part, and a drain hole formed in a bottom portion of the water collecting part.

In accordance with another embodiment, an outboard motor can include an engine configured to drive a propulsion device, a cowling covering the engine, and a fresh air intake opening formed in the cowling configured to guide fresh air into an interior of the cowling. An engine compartment can be defined in the cowling. The outboard motor can also comprise a bottom part defined below the engine compartment and means for collecting water in the cowling into a chamber within the cowling and for draining the water to an outside of the outboard motor.

BRIEF DESCRIPTION OF THE DRAWINGS

These and other features, aspects, and advantages of the present inventions are described below with reference to the drawings of preferred embodiments, which embodiments are intended to illustrate and not to limit the present inventions.

DETAILED DESCRIPTION OF THE PREFERRED EMBODIMENT

FIGS. 1–10 illustrate cowling assemblies for an outboard motor 1 configured in accordance with certain features, aspects, and advantages of at least one of the inventions described herein. Various cowling assemblies disclosed herein can be used with other types of devices that benefit from cowling types of enclosures. Such applications will be apparent to those of ordinary skill in the art in view of the description herein. These inventions are not limited to the embodiments described, which include the preferred embodiments, and the terminology used herein is not intended to limit the scope of the present inventions.

Figure 1:
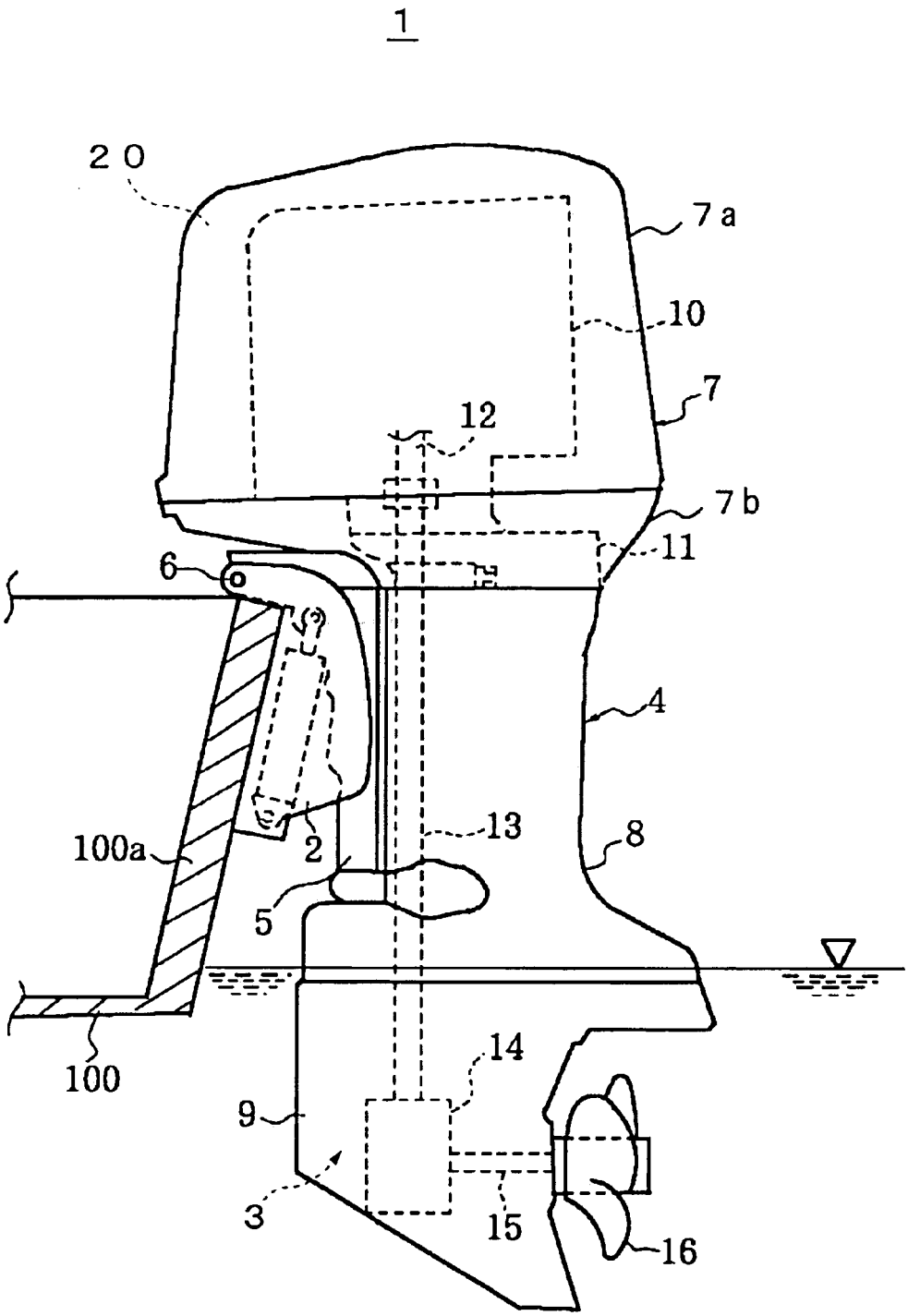
FIG. 1 is a schematic and side elevational view of an outboard motor mounted on a hull of an associated watercraft (partially shown in section) with certain internal components of the outboard motor shown in phantom.

FIG. 1 is a side view of an outboard motor mounted on a hull 100. An outboard motor 1 according to the illustrated embodiment can be attached to a transom board 100*a* of a hull 100 by means of a clamp bracket 2. A swivel bracket 5 for elastically supporting a propulsion unit 4 can be attached to the clamp bracket 2 with a tilt shaft 6 in the manner that the swivel bracket 5 can pivot about the tilt shaft 6 in the up-and-down direction.

The propulsion unit 4 can have a housing composed of a cowling 7, an upper casing 8, and a lower casing 9. The cowling 7 can have a top cowling 7*a* and a bottom cowling 7*b*. The top cowling 7*a* can be detachably mounted on the bottom cowling 7*b*.

A four-stroke engine 10 can be located in an engine compartment 20 defined in the cowling 7. However, this is merely one exemplary type of engine that can be used at the engine 10. Other types of engines, operating on other principles (e.g., 2-stroke, rotary, etc) can also be sued.

The engine 10 can be mounted on an exhaust guide 11. The exhaust guide 11 can be located in the bottom cowling 7*b*. The upper casing 8 can be attached to a bottom portion of the bottom cowling 7*b*.

A casing made up of the upper casing 8 and the lower casing 9 covers a propulsion device 3. The propulsion device 3 can include a drive shaft 13, a forward-reverse shifting mechanism 14, a propeller shaft 15, and a propeller 16. A crankshaft 12, disposed vertically in the engine 10, can be connected to the upper end of the drive shaft 13 running vertically through the inner space of the upper casing 8.

The lower end of the drive shaft 13 can be connected to the forward-reverse shifting mechanism 14 accommodated in the lower casing 9. The propeller shaft 15 can extend generally horizontally from the forward-reverse shifting mechanism 14. The propeller 16 be attached to the rear end of the propeller shaft 15, where the propeller shaft 15 sticks out from the lower casing 9.

Figure 9:
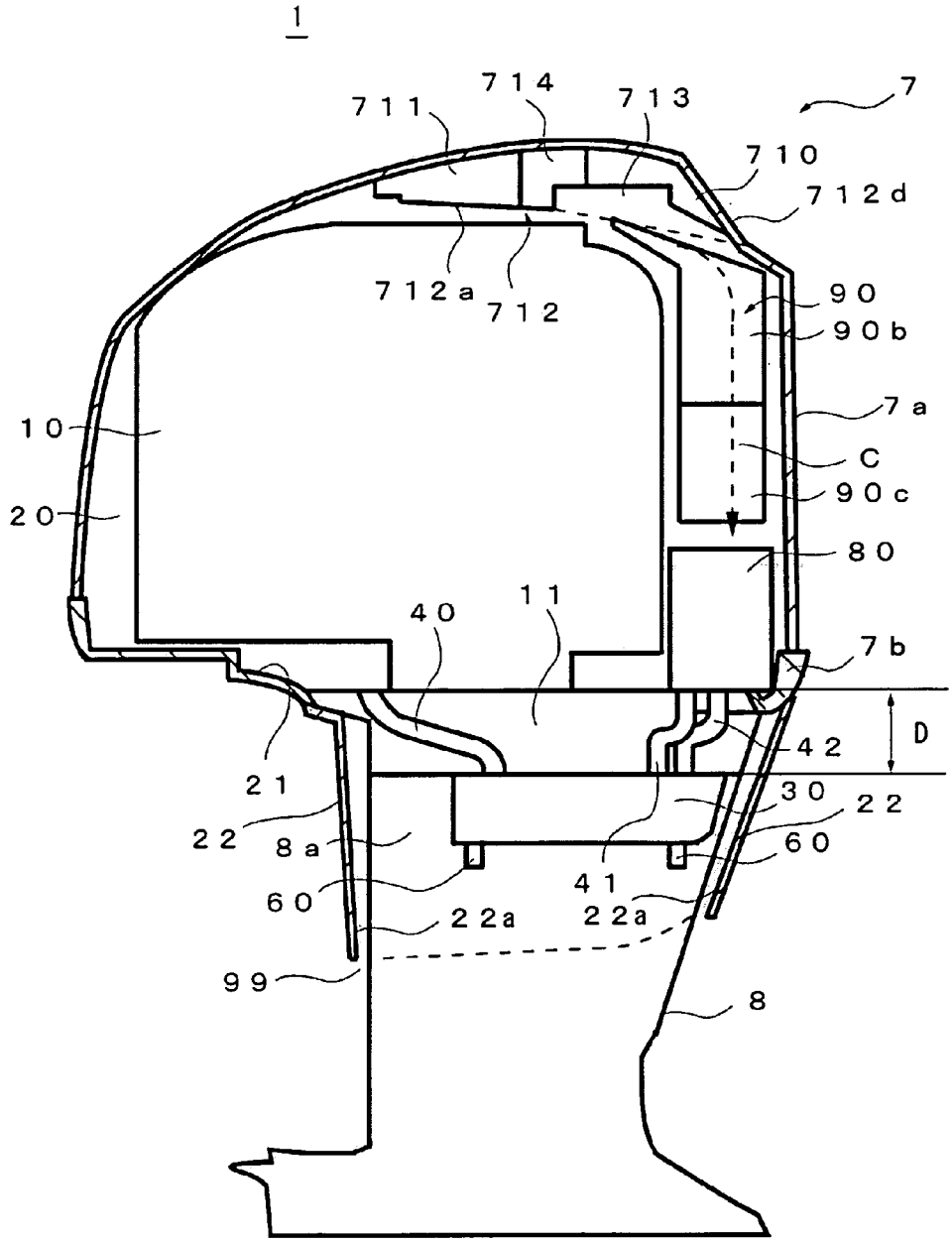
FIG. 9 is a schematic side elevational view of a modification of the outboard motor of FIG. 1, in which an upper portion thereof is partially cut away and a lower is not illustrated.

With reference to FIG. 9, the top cowling 7*a* of this embodiment has fresh air intake openings 710 and an intake air chamber 711, a space lying in between the fresh air intake openings 710 and an intake air duct 713. The air drawn in through the fresh air intake openings 710 can be led to the engine compartment 20 by way of the intake air chamber 711 and then the intake air duct 713.

The intake air duct 713 can be formed on a molding 712, however, other configurations can also be used. The molding 712 can be inserted into the top cowling 7*a* from below and attached to the inner face of a cowling upper part 700*a*. As the molding 712 can be attached in such a manner, the intake air chamber 711 as a space for communicating the fresh air intake openings 710 and the intake air duct 713 can be defined in the top cowling 7*a*.

The molding 712 can have a bottom wall 712*a*. The intake air duct 713 can be formed on a central portion of the bottom wall 712*a*. An intake air chamber front wall 712*c* can be formed forward of the bottom wall 712*a*. Also a wall 712*d* can be formed rearward from the bottom wall 712*a*. The wall 712*d* can be a wall for parting the left and the right fresh air intake openings 710.

In the top plan view, the intake air chamber front wall 712*c* can be shaped so that its center portion 712*c*1 projects longitudinally rearward of the outboard motor, forming inclined faces 712*c*2 at both sides of the apex. According to this embodiment, the center portion 712*c*1 of the intake air chamber front wall 712*c* projects longitudinally rearward of the outboard motor, generally taking the shape of letter V.

The presence of the wall 712*d* of the molding 712 allows the fresh air intake openings 710 to be provided separately on both sides of the wall 712*d*. The left and right fresh air intake openings 710 penetrate to the left and the right ends 712*c*3 of the intake air chamber front wall 712*c*. In addition, bulkheads 714 can be formed on the molding 712, extending generally along the longitudinal axis of the outboard motor, and located on both sides of the intake air duct 713. The bottom wall 712*a* and the inner face of the cowling upper part 700*a* are connected by the bulkheads 714.

Figure 4:
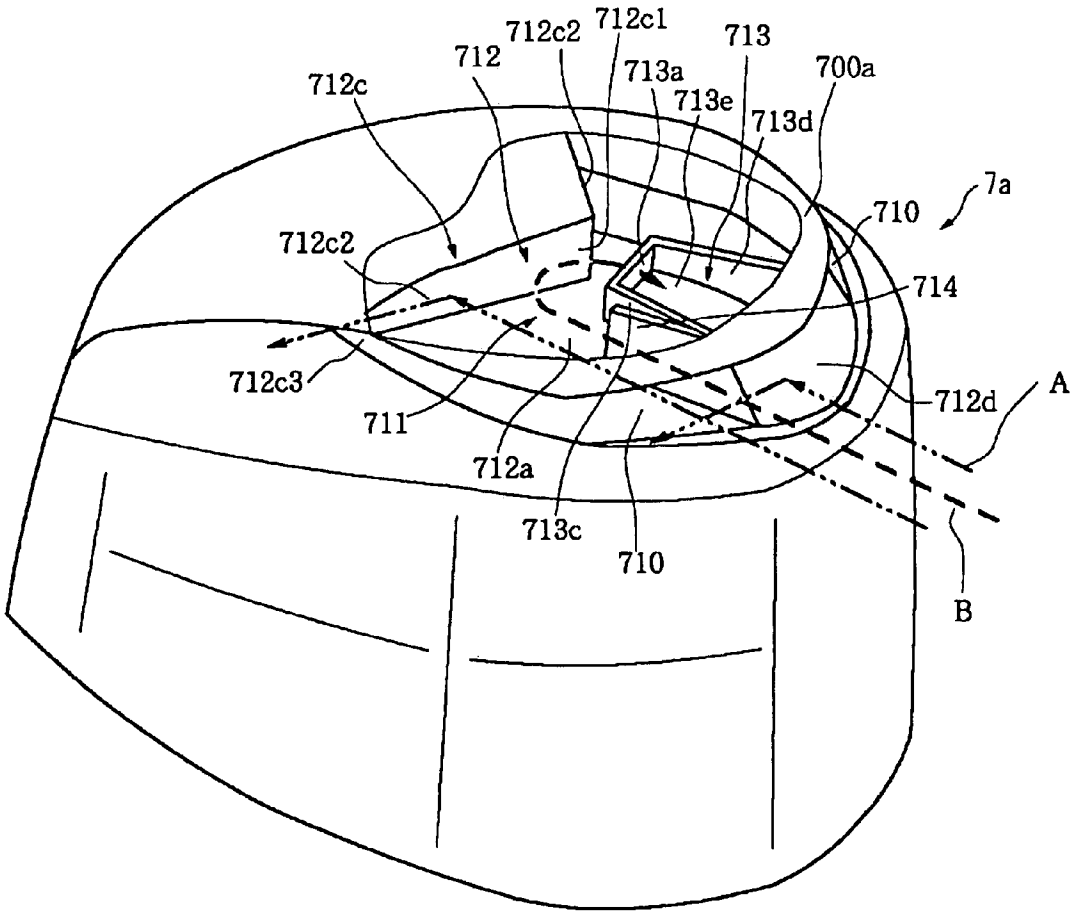
FIG. 4 is a top, rear and left side perspective view of a top cowling that can be used with the outboard motor of FIG. 1.
Figure 5:
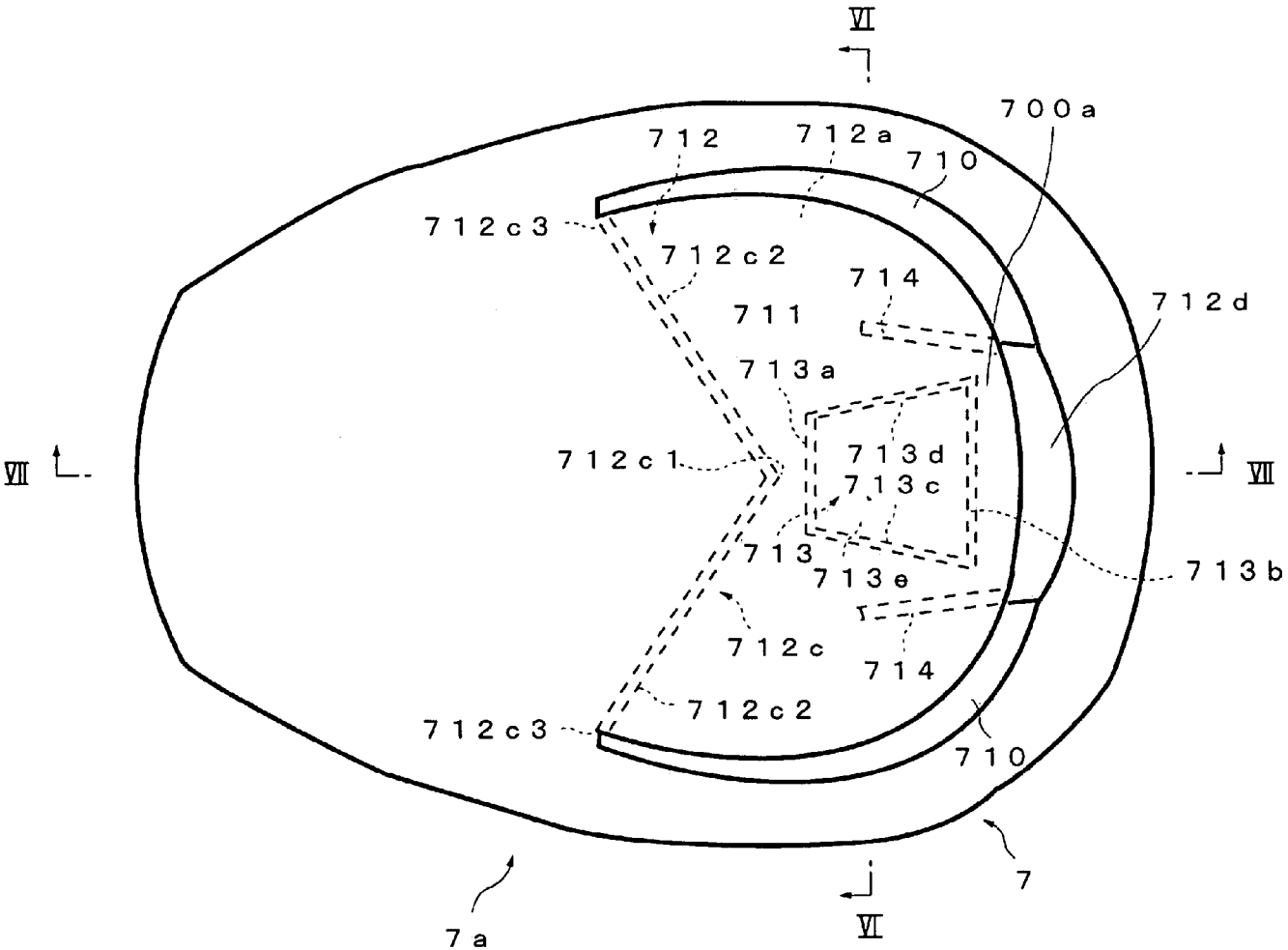
FIG. 5 is a top plan view of the top cowling of FIG. 4 with certain internal components shown in phantom.
Figure 6:
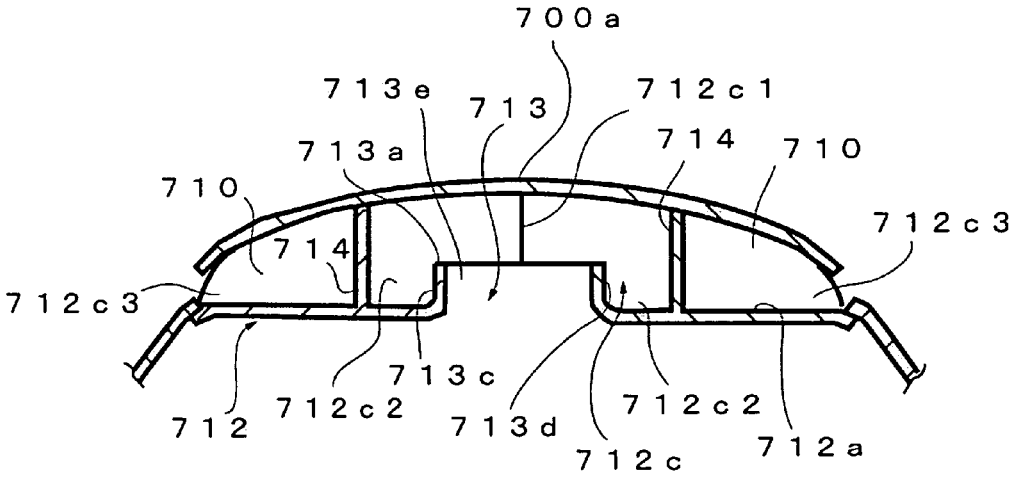
FIG. 6 is an enlarged cross-sectional view of the top cowling, taken along the line VI—VI in FIG. 5.
Figure 7:
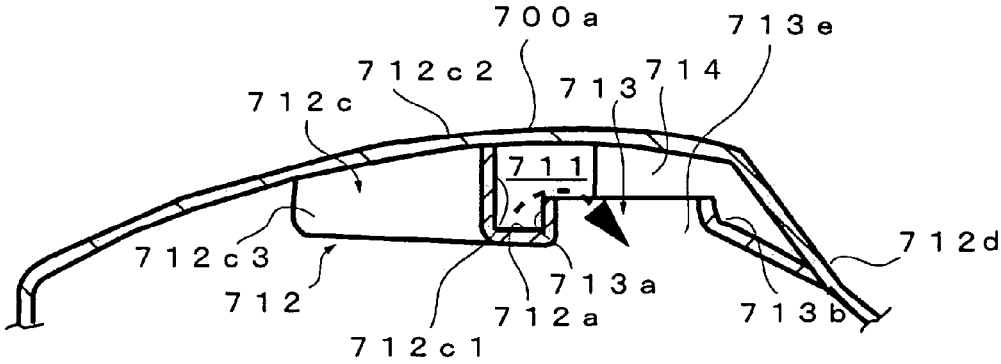
FIG. 7 is an enlarged cross-sectional view of the top cowling, taken along the line VII—VII in FIG. 5.

According to such embodiments, water can enter the intake air chamber 711 from the left and right fresh air intake openings 710 when the outboard motor encounters a wave from the rear, for example, at the time of deceleration or traveling in reverse. However, as shown in FIG. 4, water can be drained off the outboard motor taking a route "A" indicated by the alternate long and two short dashes line arrow, since it can be guided by the bulkhead 714 of the molding 712 and the intake air chamber front wall 712*c*. The air can be delivered from the intake air chamber 711 into the engine compartment 20 through the intake air duct 713 taking a route "B" indicated by the dotted line arrow.

As described above, the center portion of the intake air chamber front wall 712*c*, in the top plan view, projects longitudinally rearwardly away from the outboard motor, generally taking the shape of letter V, and accompanied by the inclined faces 712*c*2 at both sides of the apex. Thus, when water enters from the fresh air intake openings 710 on the right and the left, it hits and then flows along the inclined faces 712*c*2 of the intake air chamber front wall 712*c*, to be drained quickly without substantially changing the direction of flow.

In addition, the bulkheads 714 can be provided on the left and right sides of the intake air duct 713 and extend generally along the longitudinal axis of the outboard motor. The outboard motor can encounter a wave from an obliquely rearward direction when it is steered during reverse operation, for instance. In such a situation, the bulkheads 714 provided on both sides of the intake air duct 713 can effectively block the water coming into the intake air duct 713 from the obliquely rearward direction.

The bulkheads 714 located on both sides of the intake air duct 713 can be extend from both ends of a rear wall 713*b* of the intake air duct 713, or from both ends of the wall 712*d* of the molding 712. The intake air duct 713 can be disposed in the generally central portion of the intake air chamber 711. This accelerates drainage, to the left and right, of water that enters the intake air chamber 711 from longitudinally rearward of the outboard motor, which allows effective water separation.

Figure 2:
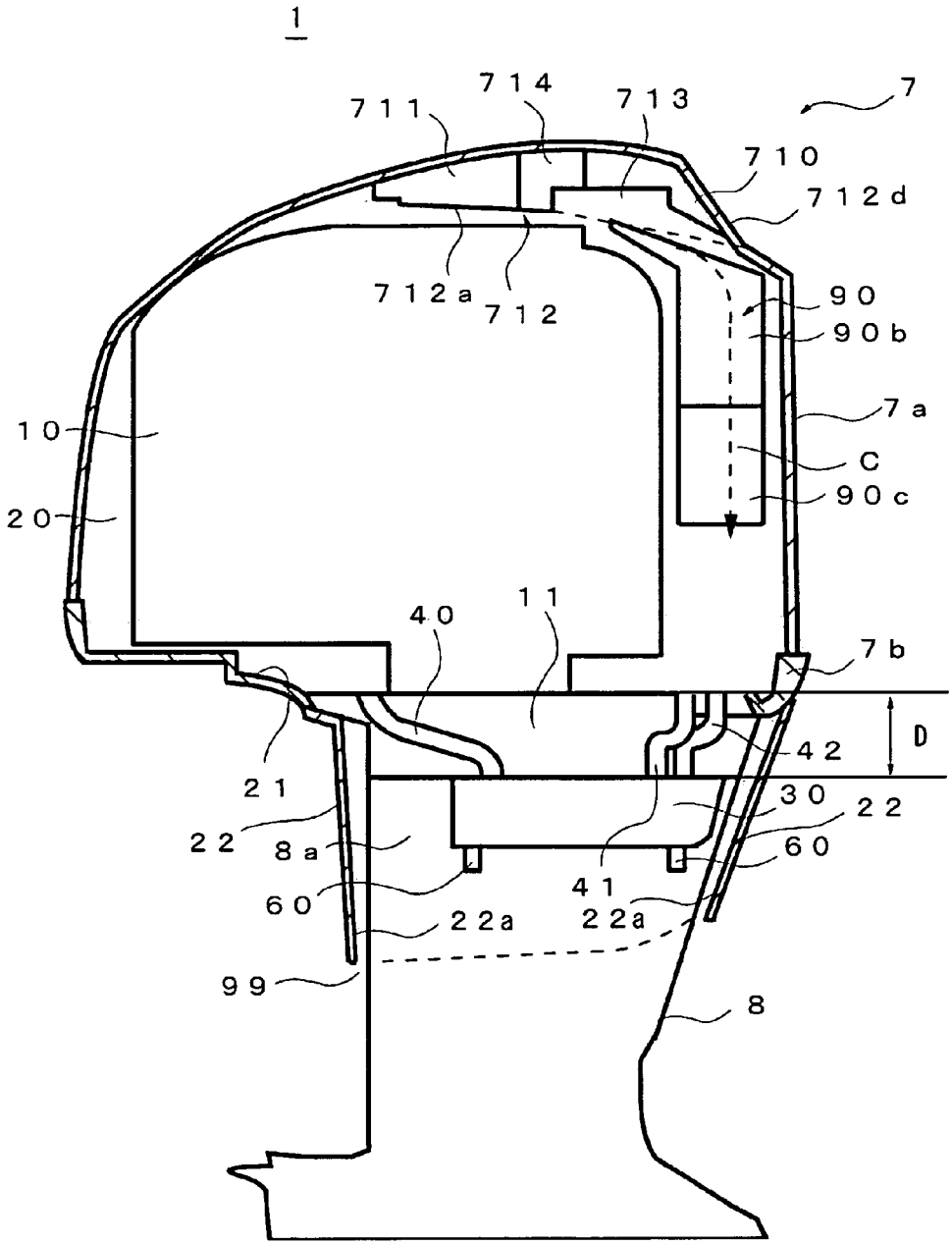
FIG. 2 is an enlarged side elevational and partial sectional view of the outboard motor of FIG. 1, in which an upper portion of the outboard motor is partially cut away and a lower portion thereof is not illustrated.
Figure 3:
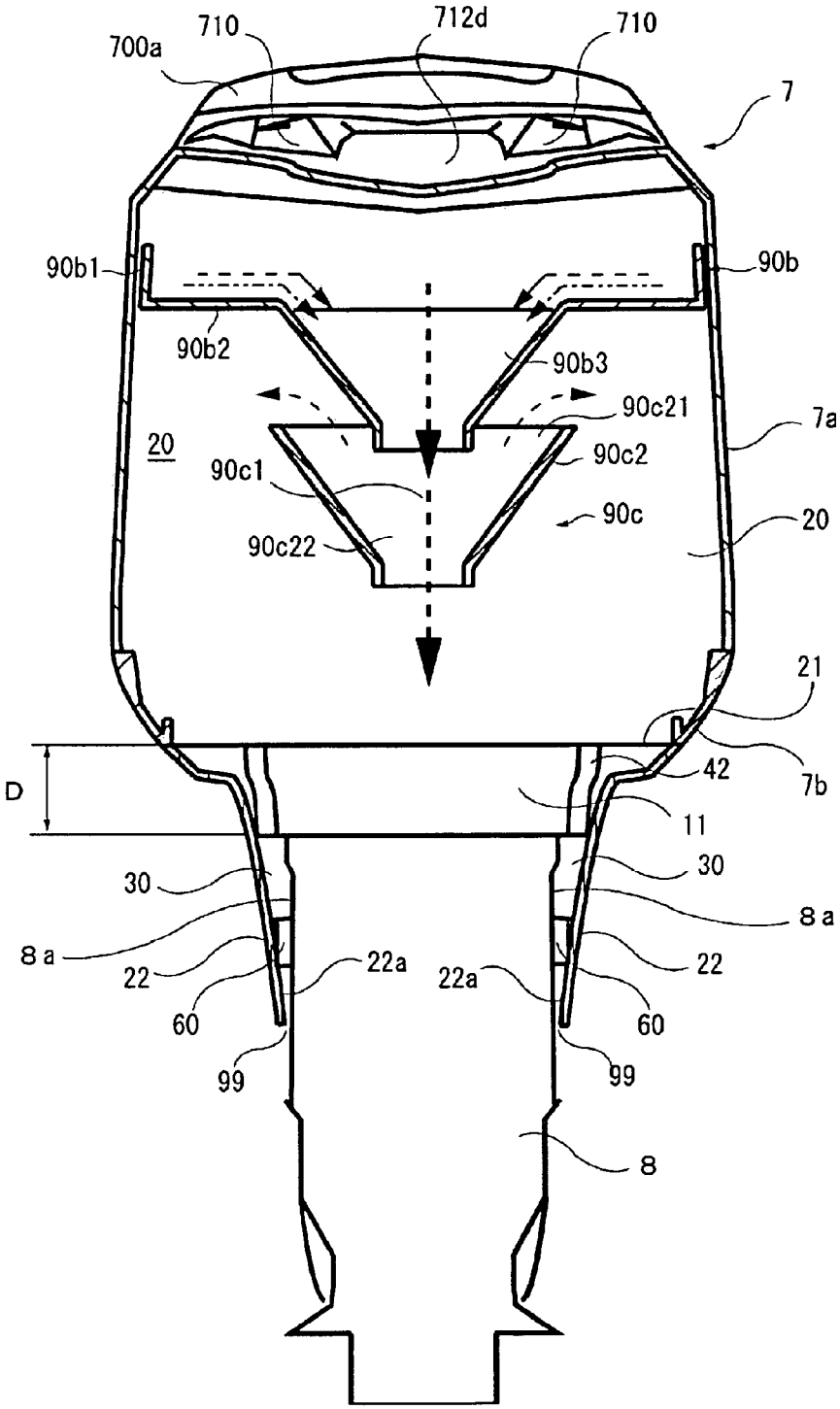
FIG. 3 is a partially cutaway and rear elevational view of the outboard motor of FIG. 1, in which the lower portion of the outboard motor is not illustrated.

According to this embodiment, a water-draining intake air guide 90 can be provided in the cowling 7 as shown in FIGS. 2 and 3. This structure prevents water from scattering when the water enters the cowling 7 from the intake air duct 713 and get trapped. Thus, the structure to prevent incoming water into the cowling 7 from dripping onto the engine 10 is accomplished.

The water-draining intake air guide 90 can include a guide cover 90*b* and a duct 90*c*. The guide cover 90*b* can be suitably shaped to collect water, by forming a vertical rib 90*b*1 on its periphery, and providing an opening 90*b*3 in the bottom face 90*b*2 and longitudinally rearward of the outboard motor. The bottom face 90*b*2 extends downwardly so as to guide water toward the opening 90*b*3.

A water passage 90*c*1 can be formed in the duct 90*c*, and an air passage 90*c*2 can be formed in the water passage 90*c*1 in communication therewith. An air opening 90*c*21 provided at one end of the air passage 90*c*2 and can open upwardly and can communicate with the inner space of the cowling 7, while an air opening 90*c*22 provided at the other end of the air passage 90*c*2 opens downwardly, by which the air separated from water flowing through the water passage 90*c*1 can be introduced into the engine compartment 20.

The water passage 90*c*1 for guiding water flow can be provided in the duct 90*c* of the water-draining intake air guide 90. Water entering from the intake air duct 713 can be introduced from the opening 90*b*3 of the guide cover 90*b* by way of the water passage 90*c*1. Thus, the engine 10 can be protected from being exposed to water. Also the air passage 90*c*2 can be formed in the water passage 90*c*1 in communication therewith. The water passage 90*c*1 also works as an intake air passage.

The air separated from water in the water passage 90*c*1 can be introduced into the engine compartment 20 by way of the air passage 90*c*2. As described above, the water passage 90*c*1 serves as an intake air passage having water separating function. This arrangement, combined with the water separating structure provided in the intake air chamber 711, provides enhanced positive water separation.

The outboard motor 1 can have a bottom part 21, defined by a lower portion of the bottom cowling 7*b*, below the engine compartment 20 and above the exhaust guide 11. As shown in FIGS. 2 and 3, the upper casing 8 can be located below the bottom cowling 7*b*. The upper peripheral area of the upper casing 8 can be covered with a cover 22. The cover 22 is also called an apron, and can be made of a resin material for example. The cover 22 covers and protects a lower part of the bottom cowling 7*b* and an upper portion of the upper casing 8.

A water collecting part 30 can be disposed between the upper portion 8*a* of the upper casing 8 and the cover 22 and on the left and right sides of the upper portion 8*a* of the upper casing 8, and water can be received by the water collecting part 30. The water collecting part 30 can be of any shape and size as long as the water collecting part 30 can receive water. The water collecting part 30 can be disposed below the bottom part 21.

Since the water collecting part 30 according to this embodiment can be disposed maximizing the space defined between the upper portion 8*a* of the upper casing 8 and the cover 22, and has a shape to fit in such space, an increase in overall size of the outboard motor 1 can be prevented.

In some embodiments, the water collecting part 30 can be formed and located separately from the upper casing 8 and the cover 22. However, the water collecting part 30 may be integrally formed with the upper casing 8 or the cover 22, in which case there is no need to mount the water collecting part 30 separately, so that mounting work becomes easy.

Further, in some embodiments, the left and right water collecting parts 30 can have the same shapes and sizes. In other embodiments, the left and right water collecting parts 30 can have different shapes and sizes. Alternatively, the water collecting part 30 can be disposed either on the left or right side. Alternatively, a plurality of water collecting parts 30 can be disposed on one or both of the left and right sides. Alternatively, the water collecting part 30 can be disposed between the upper portion 8*a* of the upper casing 8 and the cover 22, along the entire periphery thereof. However, other configurations and arrangements can also be used.

The bottom part 21 and the left and right water collecting parts 30 can be in communication with each other through a front water passage 40 and rear water passages 41, 42. Water that entered the bottom part 21 can flow downwardly through the front water passage 40 and the rear water passages 41, 42 and can be received by the water collecting parts 30. The front water passage 40 can be tubing made of metal, resin or the like. The rear water passages 41, 42 are also tubing made of metal, resin or the like. However, other materials can also be used.

Figure 8:
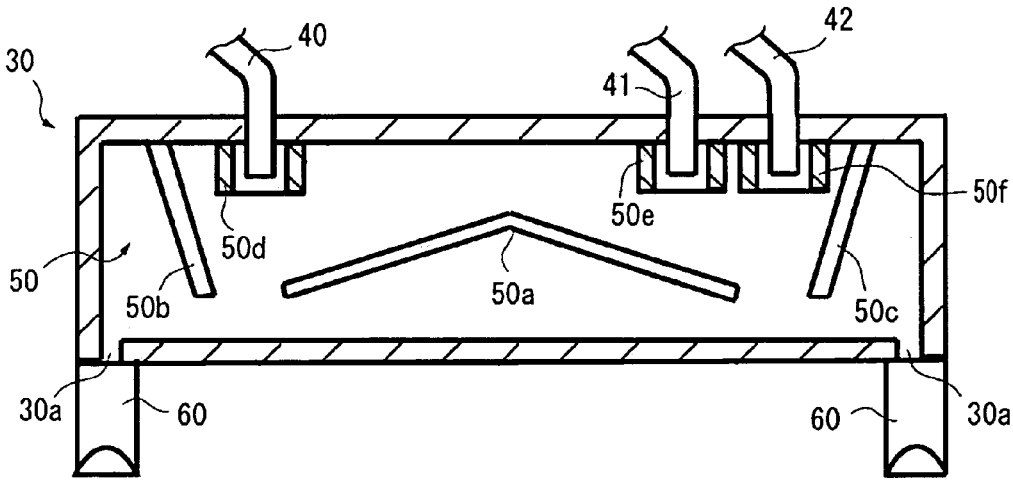
FIG. 8 is an enlarged cross-sectional view of the top cowling, showing a labyrinth structure inside a water collecting part.

As shown in FIG. 8, the water collecting part 30 can be formed in the shape of a box, and can have drain holes 30*a* on both sides of a bottom portion. Water that collects in the water collecting part 30 can be drained through the drain holes 30*a*.

The water collecting part 30 can have a labyrinth structure 50. The labyrinth structure 50 can prevent water drops in the water collecting part 30 from being drawn back upwardly through the front water passage 40 and the rear water passages 41, 42 and entering the cowling 7 due to the negative pressures generated by the engine 10.

The labyrinth structure 50 can include bulkheads 50*a* through 50*c* and tubular parts 50*d* through 50*f* located in the water collecting part 30. However, other configurations can also be used.

The bulkhead 50*a* can have an angled cross section. The bulkhead 50*a* can be located in a central portion of the water collecting part 30, and can be configured to prevent water drops sucked into the water collecting part 30 through the drain holes 30*a* from flowing upwardly toward the passages 40, 41, 42.

For example, the bulkhead 50*b* and the bulkhead 50*c* can be located on both sides of a top portion of the water collecting part 30 and can extend therefrom to the area between an end of the bulkhead 50*a* and the drain hole 30*a*. As such, the bulkheads 50*b*, 50*c* can prevent water drops in the water collecting part 30 from flowing upwardly and entering the front water passage 40 and the rear water passages 41, 42.

In some embodiments, the tubular part 50*d* can be located to enclose a lower part of the front water passage 40. The tubular part 50*e* can be located to enclose a lower part of the rear water passage 41. The tubular part 50*f* can be located to enclose a lower part of the rear water passage 42. These tubular parts 50*d*, 50*e*, and 50*f* can further aid in preventing the entry of water drops into the front water passage 40 and the rear water passages 41, 42, respectively, from the lower ends thereof.

A duckbill-type check valve 60 can be disposed at the drain hole 30*a* of the water collecting part 30. Water drained from the duckbill-type check valve 60 can be discharged outside through a gap 99 between the upper portion 8*a* of the upper casing 8 and a lower portion 22*a* of the cover 22.

Since the water collecting part 30 has the duckbill-type check valves 60, even when the outboard motor 1 encounters a big wave, for example, and can be soaked in water up to a position above the water collecting part 30, water can be prevented from entering the water collecting part 30. Water cannot be drained from the water collecting part 30 while the outboard motor 1 is soaked in water up to a position above the water collecting part 30. However, since there is a head difference D between the bottom part 21 and the water collecting part 30, drainage from the bottom part 21 to the water collecting part 30 can be carried out smoothly.

In this embodiment, the bottom part 21 and the water collecting part 30 are in communication with each other through the front water passage 40 and the rear water passages 41, 42 defining a first water passage. Thus, it is possible to increase the distance between the bottom part 21 and the top end of the water collecting part 30, thereby providing the head difference D large enough to compensate the effect of a negative pressure produced by a large engine. Therefore, even when a higher negative pressure can be produced in the cowling with the operation of the engine 10, water that collects in the water collecting part 30 is not affected by the negative pressure and can be drained smoothly from the drain hole 30*a* through the duckbill-type check valve 60.

Even when a large volume of water enters the cowling through the fresh air intake openings 710, the water flows from the bottom part 21 into the water collecting part 30 through the front water passage 40 and the rear water passages 41, 42 as the first water passage and collects in the water collecting part 30. Thus, the water can be prevented from being trapped in the bottom part 21.

Since the bottom part 21 and the water collecting part 30 are in communication with each other through the front water passage 40 and the rear water passages 41, 42 as the first water passage, flexibility in the location of the water collecting part 30 can be increased. The plural water passages are provided, including the front water passage 40 and rear water passages 41, 42. Thus, water that entered the cowling can be introduced into the water collecting part 30 even when the attitude of the outboard motor 1 can be changed to a tilted state. For example, when the plural water passages are constructed with the front water passage 40 and the rear water passages 41, 42 disposed with a certain distance therebetween in the longitudinal direction of the outboard motor as in this embodiment, water can be introduced into the water collecting part 30 through the front water passage 40 when the outboard motor 1 can be tilted or through the rear water passages 41, 42 when the watercraft is in a swamped state. Water can thus be introduced into the water collecting part 30 even when the outboard motor is tilted or when the watercraft is in the swamped state.

The water collecting part 30 can be disposed on the left and right sides. The left and right water collecting parts 30 and the bottom part 21 are in communication with each other through the front water passage 40 and the rear water passages 41, 42 as the first water passage. The first water passage can be disposed on the left and right sides with a certain distance. Thus, water can be introduced into the water collecting parts 30 even when the outboard motor 1 can be accelerated or decelerated while being steered.

For example, when the outboard motor 1 is accelerated while being steered to the right, water can be introduced into the water collecting part 30 through the rear water passages 41, 42 on the right. When the outboard motor 1 is accelerated while being steering to the left, water can be introduced into the water collecting part 30 through the rear water passages 41, 42 on the left.

Additionally, when the outboard motor 1 is decelerated while being steered to the right, water can be introduced into the water collecting part 30 through the front water passage 40 on the right. When the outboard motor 1 is decelerated while being steering to the left, water can be introduced into the water collecting part 30 through the front water passage 40 on the left.

The water collecting part 30 can be disposed below the bottom part 21. Thus, even when the outboard motor 1 ships a big wave and can be soaked in water up to a position above the water collecting part 30, water flows from the bottom part 21 into the water collecting part 30 through the front water passage 40 and the rear water passages 41, 42 as the first water passage and collects in the water collecting part 30. Therefore, it takes time for the water collecting part 30 to be filled with water. In other words, as long as the outboard motor 1 ships a wave temporarily, or for a short time, no water flows back to the bottom part 21 from the water collecting part 30. Thus, the head difference D required for drainage can be obtained, thereby preventing drainage performance from being reduced.

Figure 10:
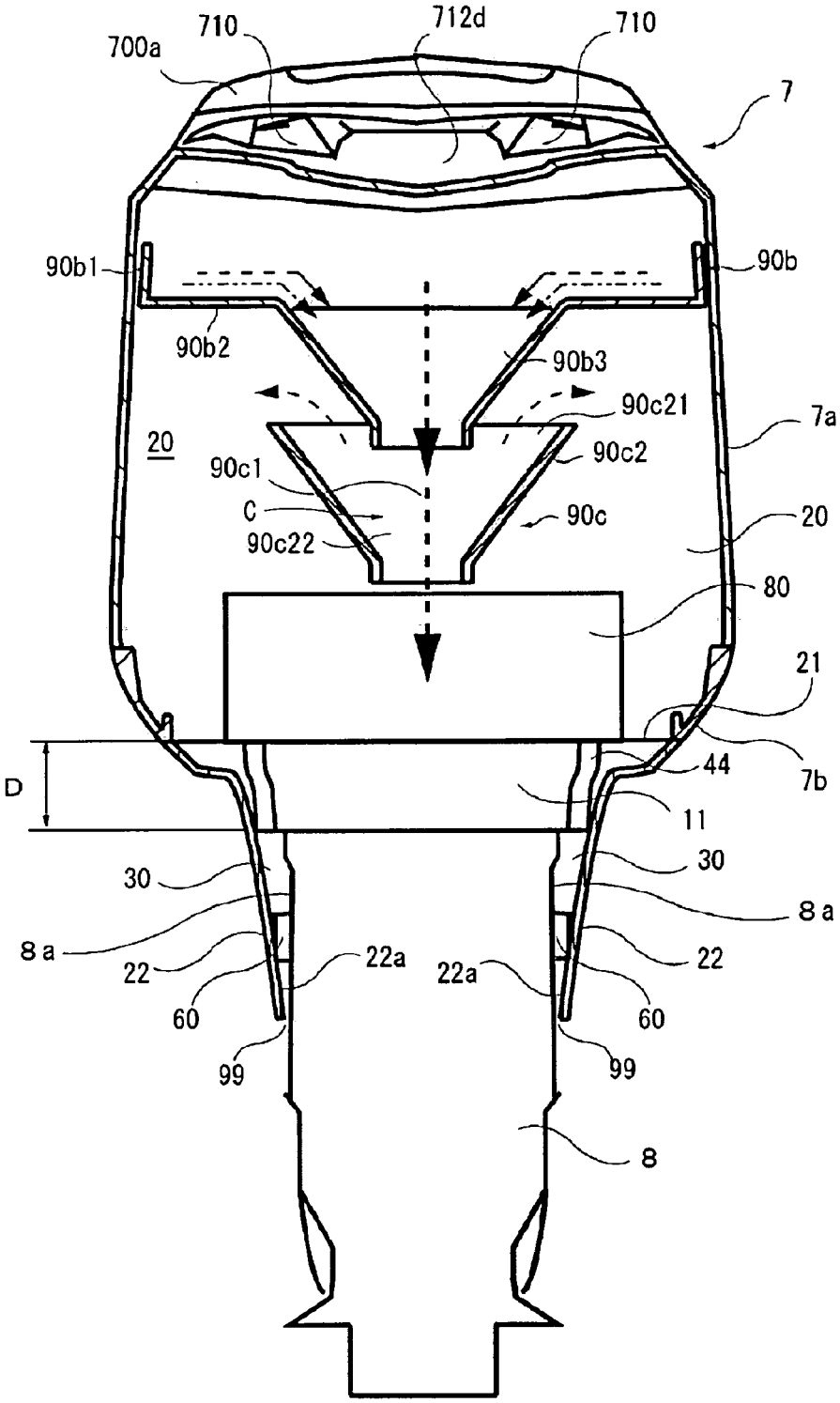
FIG. 10 is a partially cutaway, rear elevational view of the outboard motor of FIG. 9, in which the lower portion of the outboard motor is not illustrated.
Figure 11:
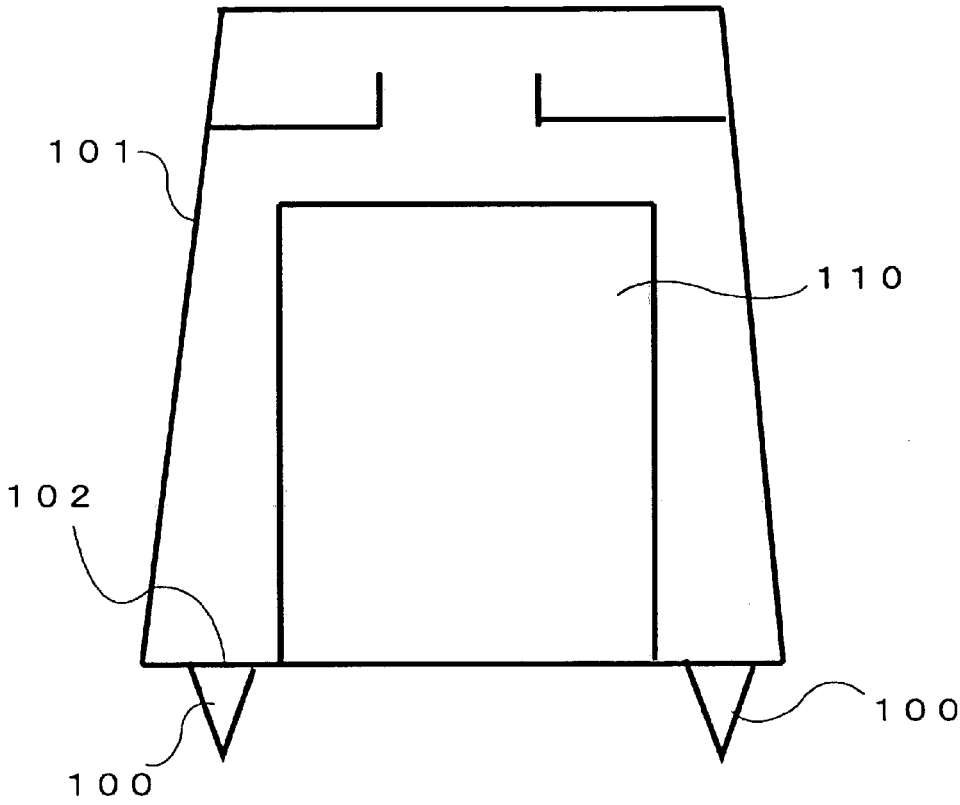
FIG. 11 illustrates drainage from a duckbill-type check valve.
Figure 12:
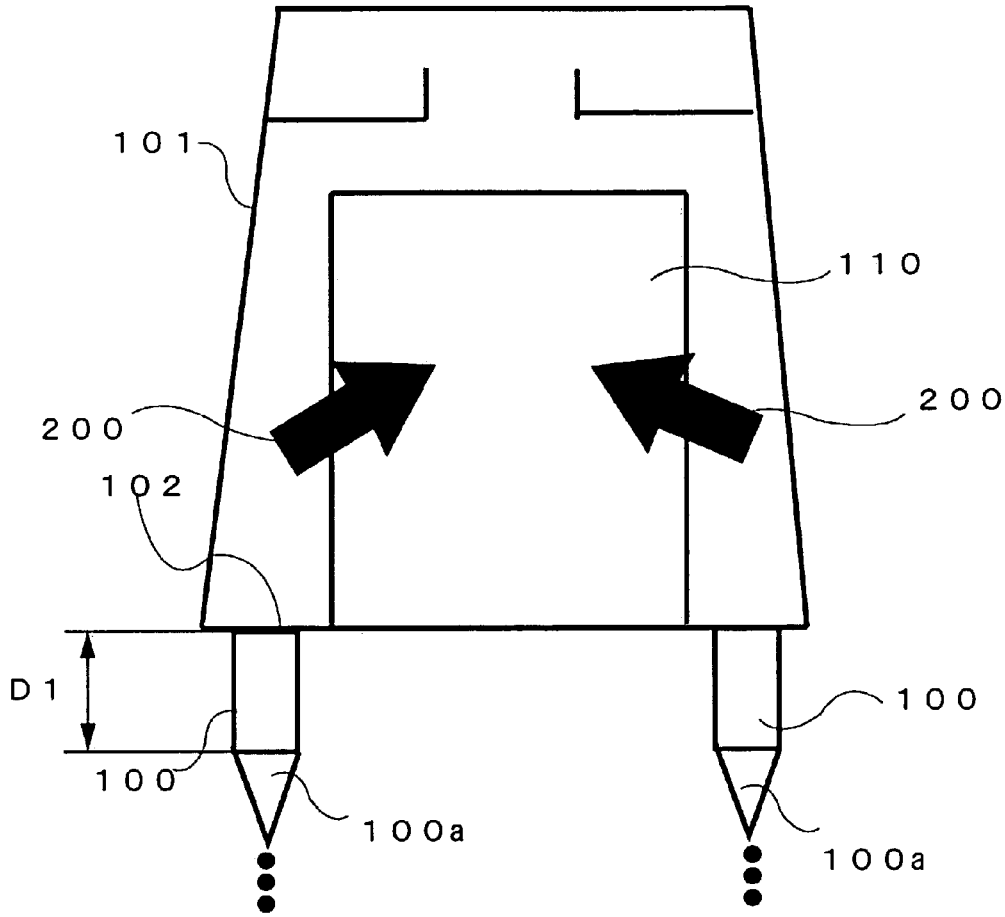
FIG. 12 illustrates drainage from the duckbill-type check valve when the valve is extended to provide a head difference.
Figure 13:
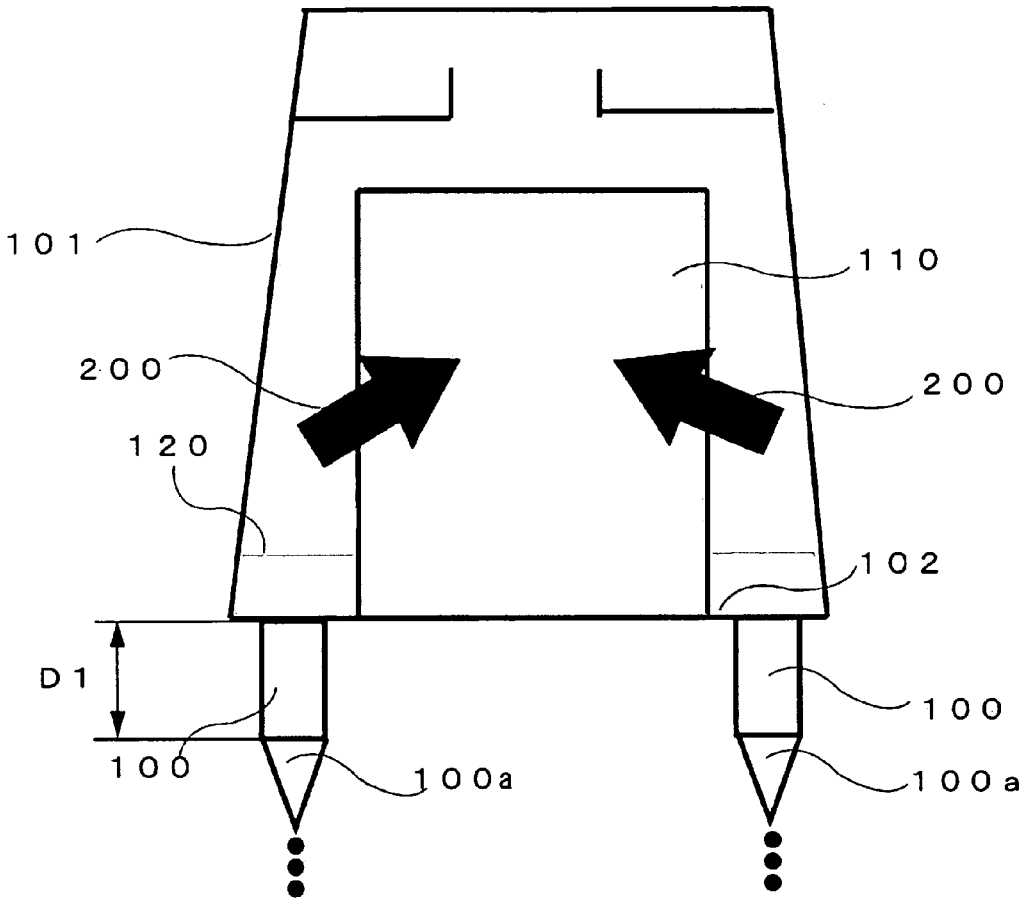
FIG. 13 illustrates a problem with the duckbill-type check valve of FIG. 12.
Figure 14:
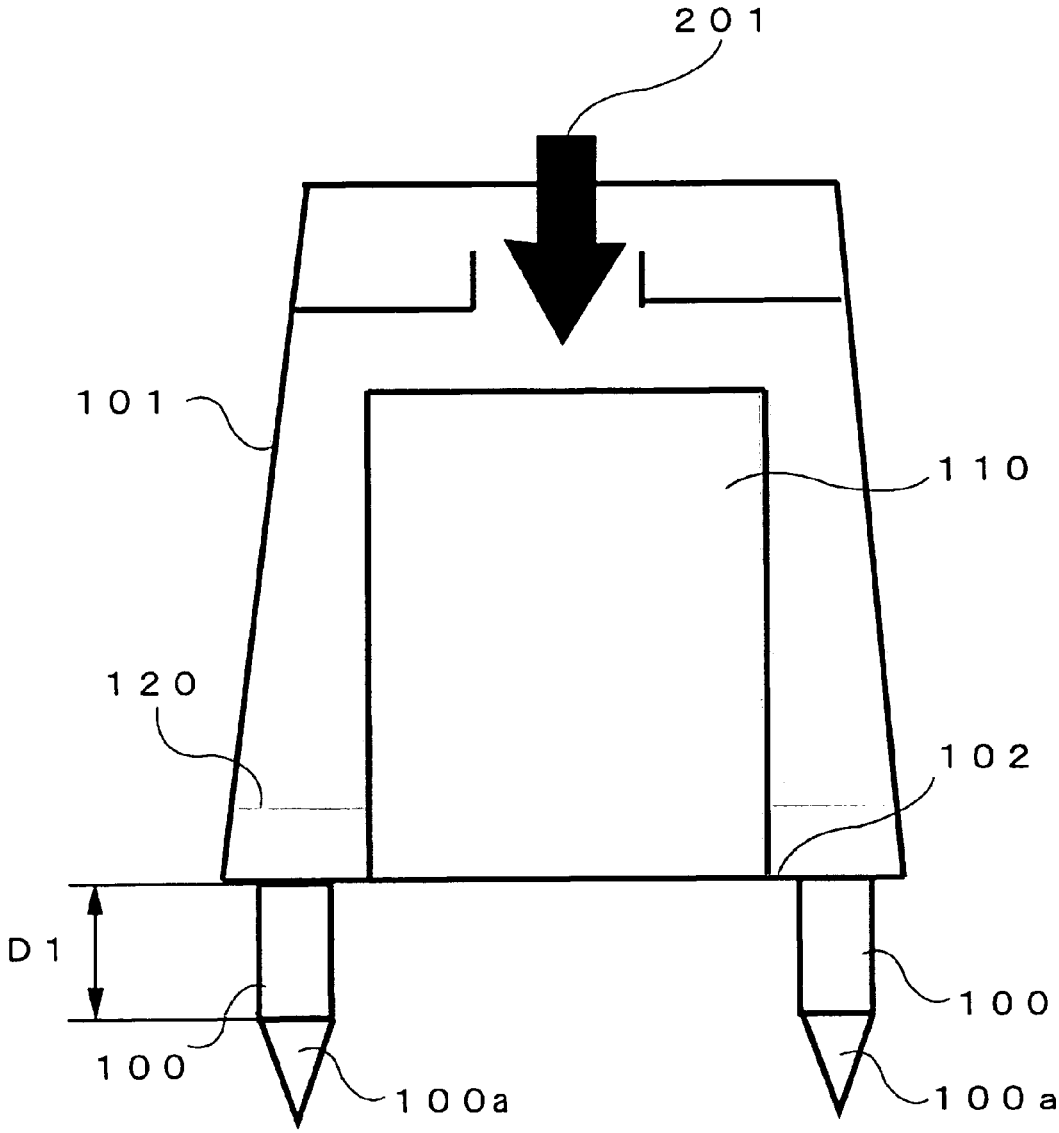
FIG. 14 illustrates another problem with the duckbill-type check valve of FIG. 12.
Figure 15:
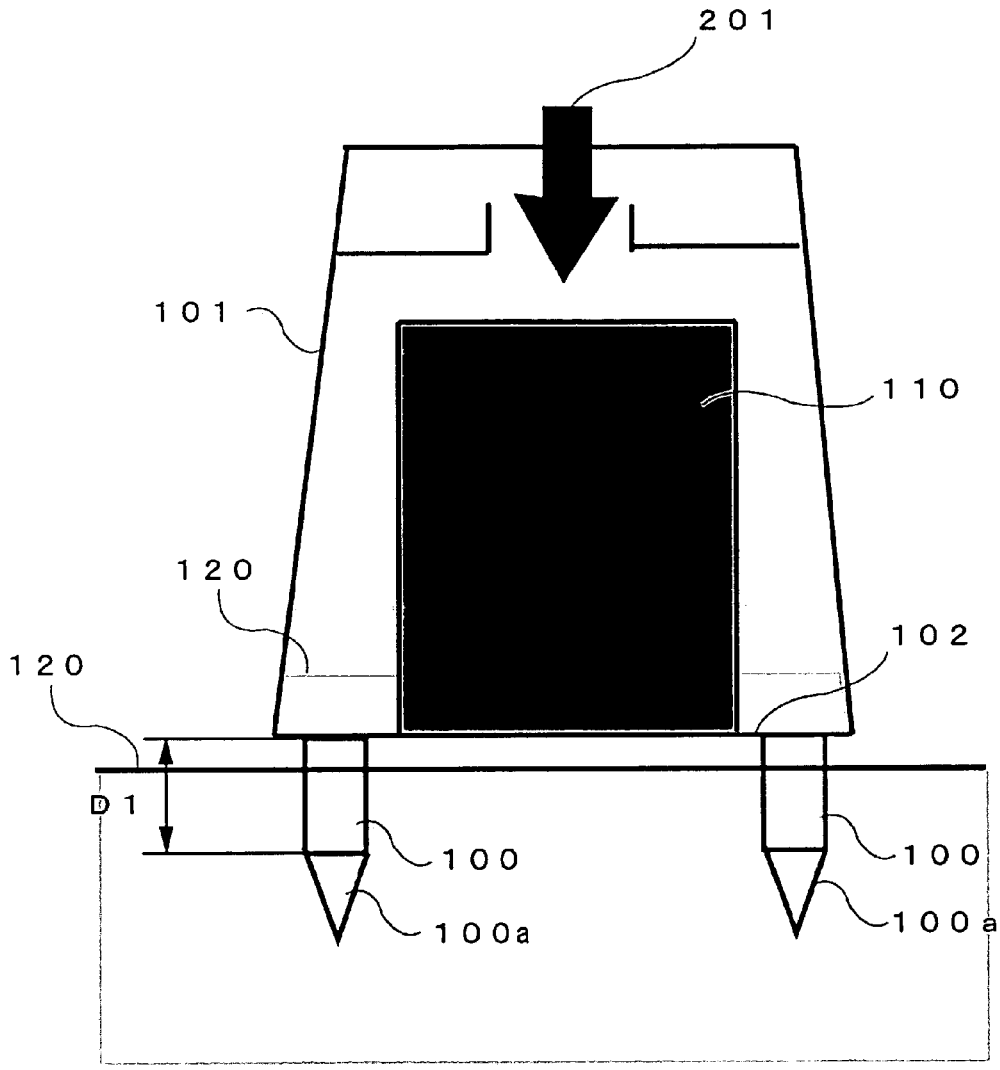
FIG. 15 illustrates still another problem with the duckbill-type check valve of FIG. 12.

Next, the structure of an outboard motor according to another embodiment is described with reference to FIGS. 9 through 10. FIG. 9 is a side view of an outboard motor, in which an upper portion thereof is partially cut away and a lower portion thereof is not illustrated. FIG. 10 is a partially cutaway, rear view of the outboard motor, in which the lower portion thereof is not illustrated.

This embodiment is constituted in a similar manner as the embodiment shown in FIGS. 2 through 8. In this embodiment, however, there can be provided at the bottom part 21 an upper water collecting part 80 for collecting water that entered the cowling 7. The upper water collecting part 80 can be located below the intake air duct 713 of the molding 712, and water that entered the cowling 7 can be guided into the upper water collecting part 80 through a water guide passage C.

The water guide passage C according to this embodiment can be defined by the water-draining intake air guide 90, which can be formed in a manner as described above and not described in detail. The water-draining intake air guide 90 can be located inside the top cowling 7*a*. The water-draining intake air guide 90 can be in communication with both intake air duct 713 and upper water collecting part 80, and guides the air separated from water flowing through the water guide passage C into the engine compartment 20 and guides the water into the upper water collecting part 80. When the water guide passage C can be provided, water that entered the cowling can be prevented from being splashed onto the engine 10 and accessory equipment before entering the upper water collecting part 80.

The upper water collecting part 80 and the water collecting part 30 are in communication with each other through rear water passages 43, 44 defining a second water passage. When a large volume of water enters the cowling 7, the water might be temporarily trapped in the bottom part 21 before flowing from the bottom part 21 into the water collecting part 30 through the front water passage 40 defining the water passage. In this embodiment, however, the upper water collecting part 80 can be disposed at the bottom part 21 so that water that entered the cowling 7 can be guided into the upper water collecting part 80 through the water guide passage C. When water that entered the cowling 7 collects in the upper water collecting part 80 in such a manner, the possibility that the water might be temporarily trapped in the bottom part 21 can be reduced, thereby preventing the splash of the water in the bottom part.

Although the present inventions have been disclosed in the context of certain preferred embodiments, it will be understood by those skilled in the art that the present inventions beyond the specifically disclosed embodiments to other alternative embodiments and/or uses of the inventions and obvious modifications and equivalents thereof. It is also contemplated that various combinations or sub-combinations of the specific features and aspects of the embodiments can be made and still fall within the scope of one or more of the inventions. It should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above.

What is claimed is:

1. An outboard motor including an engine configured to drive a propulsion device, a cowling covering the engine, a fresh air intake opening formed in the cowling configured to guide fresh air into an interior of the cowling, and an engine compartment defined in the cowling, the outboard motor comprising:

a bottom part defined below the engine compartment;

a water collecting chamber disposed below the bottom part and configured to receive water in the cowling;

a first water passage conduit connecting the bottom part and the water collecting part; and a drain hole formed in a bottom portion of the water collecting part.

2. The outboard motor according to claim 1, wherein the first water passage comprises plural water passages.

3. The outboard motor according to claim 1, further comprising an upper water collecting part disposed at the bottom part for collecting water in the cowling, and a second water passage connecting the upper water collecting part and the water collecting part.

4. The outboard motor according to claim 2, further comprising an upper water collecting part disposed at the bottom part for collecting water in the cowling, and a second water passage connecting the upper water collecting part and the water collecting part.

5. The outboard motor according to claim 1, further comprising a water guide passage configured to guide water in the cowling into the upper water collecting part.

6. The outboard motor according to claim 2, further comprising a water guide passage configured to guide water in the cowling into the upper water collecting part.

7. The outboard motor according to claim 3, further comprising a water guide passage configured to guide water in the cowling into the upper water collecting part.

8. An outboard motor including an engine configured to drive a propulsion device a cowling covering the engine, fresh air intake opening formed in the cowling configured to guide fresh air into an interior of the cowling, and an engine compartment defined in the cowling, the outboard motor comprising:

a bottom part defined below the engine compartment;

a water collecting part disposed below the bottom part and configured to receive water in the cowling;

a first water passage connecting the bottom part and the water collecting part;

a drain hole formed in a bottom portion of the water collecting part;

a labyrinth structure configured to separate water from air, the labyrinth structure being provided inside the water collecting part.

9. The outboard motor according to claim 2, further comprising a labyrinth structure configured to separate water from air, the labyrinth structure being provided inside the water collecting part.

10. The outboard motor according to claim 3, further comprising a labyrinth structure configured to separate water from air, the labyrinth structure being provided inside the water collecting part.

11. The outboard motor according to claim 1 further comprising a check valve disposed at the peripheral edge of the drain hole of the water collecting part.

12. The outboard motor according to claim 2 further comprising a check valve disposed at the peripheral edge of the drain hole of the water collecting part.

13. The outboard motor according to claim 3 further comprising a check valve disposed at the peripheral edge of the drain hole of the water collecting part.

14. The outboard motor according to claim 1, wherein the water collecting part is disposed between a casing for covering the propulsion device and a cover for covering the casing.

15. The outboard motor according to claim 1, wherein the water collecting part comprises a chamber.

16. An outboard motor including an engine configured to drive a propulsion device, a cowling covering the engine, a fresh air intake opening formed in the cowling configured to guide fresh air into an interior of the cowling, and an engine compartment defined in the cowling, the outboard motor comprising:

a bottom part defined below the engine compartment;

a chamber disposed below the bottom part with at least one conduit extending between the engine compartment and the chamber and for draining the water to an outside of the outboard motor; and means for increasing the head difference between the engine compartment and the chamber.

* * * * *